United States Patent [19]

Krieger et al.

[11] Patent Number: 4,899,516

[45] Date of Patent: Feb. 13, 1990

[54] SEALING DEVICE FOR TWO-PIECE CAPSULES

[75] Inventors: Eberhard Krieger, Weinstadt; Theo Moser, Steinenberg, both of Fed. Rep. of Germany

[73] Assignee: Robert Bosch GmbH, Stuttgart, Fed. Rep. of Germany

[21] Appl. No.: 254,624

[22] Filed: Oct. 7, 1988

[30] Foreign Application Priority Data

Oct. 7, 1987 [DE] Fed. Rep. of Germany ..... 3735260

[51] Int. Cl.[4] ..... B65B 7/28; B65B 1/00

[52] U.S. Cl. ..... 53/306; 53/329; 53/900; 118/317; 239/119

[58] Field of Search ..... 53/900, 329, 306, 308; 118/317; 239/120, 119; 156/578, 69

[56] References Cited

U.S. PATENT DOCUMENTS

| | | | |
|---|---|---|---|
| 1,077,392 | 11/1913 | Colton | 53/900 X |
| 2,811,131 | 10/1957 | Lopenski et al. | 118/317 X |
| 3,078,629 | 2/1963 | Besemer et al. | 53/900 X |
| 3,422,795 | 1/1969 | Smith | 118/317 X |
| 3,643,727 | 2/1972 | Longoni et al. | 118/317 X |
| 3,995,586 | 12/1976 | Crose et al. | 118/317 |

*Primary Examiner*—Horace M. Culver
*Attorney, Agent, or Firm*—Edwin E. Greigg

[57] ABSTRACT

A device for sealing two-piece capsules has a capsule carrier and a capsule holder which are movable relative to one another for the purpose of attaching a cap to a capsule body. In order to bond a cap firmly and tightly to the body of a capsule, the device has a nozzle for applying a viscose sealing material to the inside of the cap. To prevent an excess of sealing material from being applied to the cap, the nozzle is provided with a vacuum mechanism in the form of an annular channel by means of which excess sealing material is removed during the application.

2 Claims, 1 Drawing Sheet

11
40
5
8
6
42
41
13
3
4
7
1
2

11
5
36
37
23
22
21
26
27
29
30
33
32
13
4
35
25
24
20
28

12
10
5
14
6
13
8
15
11
4
17
18
4
16

25
23

SEALING DEVICE FOR TWO-PIECE CAPSULES

BACKGROUND OF THE INVENTION

The invention relates to a device for applying a proper amount of a sealant onto an inner surface of a cap for a twopiece capsule in which the cap is secured to the capsule body,.

as described hereinafter. A sealing device of this type is already known from German prior art DE OS No. 28 30 849 wherein a sealing medium is sprayed from an annular nozzle onto the inside of a cap. During this process it may happen that excess sealing material in the form of droplets exude to the outside and moistens not only the exterior surface of the cap but also that of the body of the capsule attached thereto. The sealing material—consisting of water, liquid gelatine, or similar bonding agents or solvents—deposited thereon etches the surface of the capsule, which likewise consists of gelatine, starch or similar soluble substances, so that there is visible damage to the otherwise smooth exterior surface. However, the excess sealing material can also cause several capsules to become glued to one another. It is also possible for excess sealing material to be forced into the inside of the capsule, thus allowing it to come into contact with the contents, which should always be avoided. It is, however, important to distribute sufficient sealing material evenly over the seam area to create a firm and tight seal, which makes packaging of liquid medication also possible with two-piece capsules. Moreover, such a seal creates a security seal which protects against unauthorized opening without destruction of the capsule. The problem addressed by the invention is, therefore, to create a sealing device for two-piece capsules which allows precise metering of the quantity of sealing material to be applied to one part of the capsule.

OBJECT AND SUMMARY OF THE INVENTION

The device of the invention has the advantage of immediately syphoning off the excess of applied sealing material, so that a uniform film of sealing material adheres to the junction area of one part of the capsule, thus assuring a tight bond between the body of the capsule and the cap. Depending on the adjustment of the vacuuming pressure, the thickness of the film can be expediently controlled, so that no sealing material exudes from the seam area when the two capsule parts are joined. The device of the invention has the additional advantage that the sealing substance can be applied close to the edge of the cap without causing some of it to be discharged over the edge to the outside. This results in a particularly firm bond between the cap part and the capsule part since the edge of the cap cannot be lifted.

The invention will be better understood and further objects and advantages thereof will become more apparent from the ensuing detailed description of preferred embodiments taken in conjunction with the drawings.

DESCRIPTION OF THE PREFERRED EMBODIMENT

Figure 3:
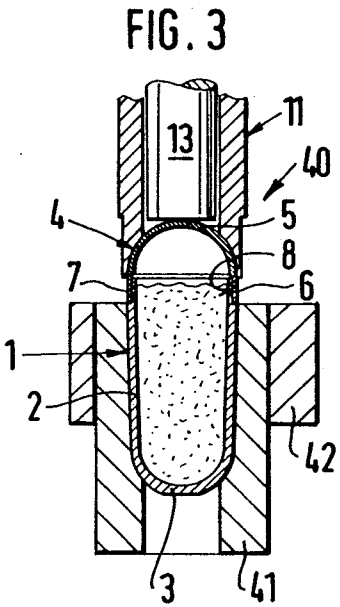
FIG. 3 is a station for attaching the cap, presented in all cases as a cross section of a sealing device for two-piece capsules.

The sealing device is part of an, as such familiar, machine for filling and sealing two-piece capsules made of hard gelatine, starch, or similar easily digestible substances, in which particularly powdered or liquid medicines are packaged. The capsules comprise a capsule body 1, which holds the filling and which has a cylindrical or conical trunk 2 and a cap-shaped bottom 3. On top of capsule body 1 a cap 4 can be placed, which has a cap-shaped cover 5 and a cylindrical projection 6, which overlaps an upper area of the capsule 2. In the illustrated design example the upper part of the body of the capsule has an external reduced upper end area 7 over which is gripped the complementally formed part 8 of the projection of cap 6 which has an inner end surface reduced area such that the combined thickness of the upper end area of the capsule body and of the end surface of the cap are of the same thickness as the main body of the cap and the capsule body. In this area of overlap, cap 4 is firmly and tightly bonded to capsule body 1 by a viscose sealing material—liquid gelatine or water, for instance—which etches the moistened surface.

To carry out the process of sealing a filled capsule body 1 with a cap 4, the sealing device has, for instance, three cap holders 11 on a cyclically rotated ratchet wheel (not shown). A cap holder 11 comprises a sleeve 12 and—guided therein with clearance—a coaxial slide rod 13. The lower end of sleeve 12 has a cap-shaped recess 14 the radius of which is adapted to the exterior radius of a cap 4. Said recess 14 partially accommodates a cap 4 which is held therein by a vacuum, which—through a bore 15 in sleeve 12 and the gap between the interior of sleeve 12 and slide rod 13—acts upon the cap 4. Said bore 15 is connected to a vacuum source 18 through a valve 17. The cap 4, which is suspended to be conveyed to the sealant application station, is removed from cap holder 11 when, after switching off the vacuum, sleeve 12 is drawn back relative to slide rod 13 whereby said slide rod 13 pushes the suspended cap 4 out of said recess 14.

Figure 2:
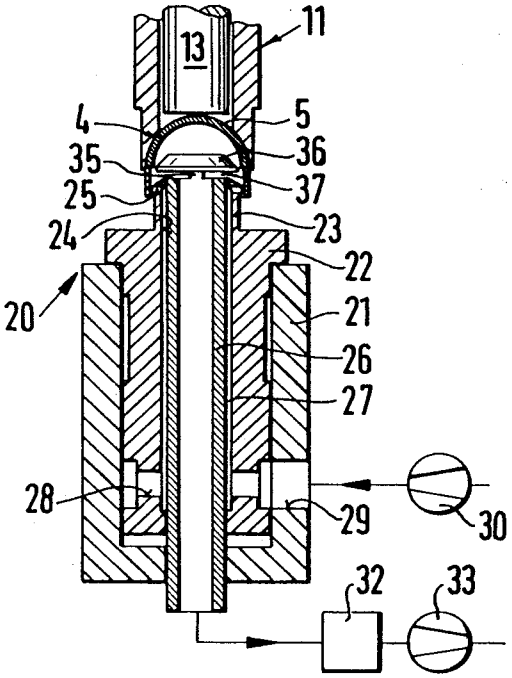
FIG. 2 is a sealing material application station.
Figure 1:
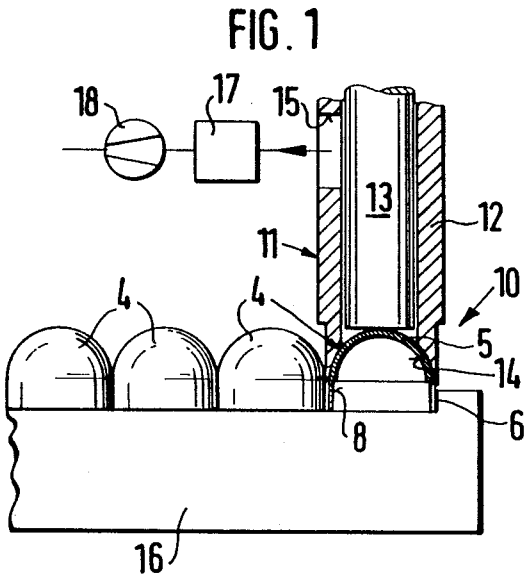
FIG. 1 shows a cap receiving station.
Figure 4:
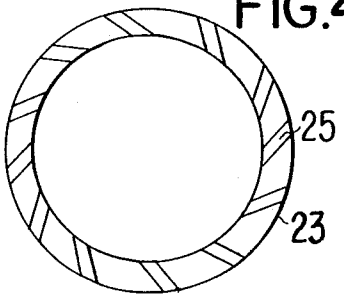
FIG. 4 is a section through the radial apertures shown in FIG. 2 which illustrates their angle with respect to a radial line.

At a cap receiving station 10 (FIG. 1) of the sealing device, a cap holder 11 always accepts the first of several caps 4 which are lined up in a feeder 16. By one turn with an upward component, translational component, and a downward component, cap holder 11 each time moves a cap 4 into the area of a sealing material application station 20 (FIG. 2). At this station, within a stationary block 21, there is situated a nozzle element 22, the upper end or head 23 of which has a slightly smaller diameter than the interior diameter of a cap 4. The nozzle element 22 has a cylindrical tube 26 coaxial therewith that forms; a cylindrical channel 24 and is provided with a plurality of apertures 25 just below the upper end of the head 23 and which lie in a diametrical plane through the head 23. The apertures 25 do not extend radially relative to the nozzle element 22 but are always tilted by 45° in relation to a radial line. In the cylindrical channel 24 of nozzle element 22 a the tube 26 restricts the cylindrical channel 24 to an annular gap or channel 27, which is closed above the apertures 25 and at the lower end of nozzle element 22. Several other apertures 28 lead, within nozzle element 22, to the annular gap 27; these apertures 28 are connected through a bore 29 within block 21 to a sealant metering pump 30 for the dosed supply of a viscose sealing material. The lower portion of tube 26 penetrates the block 21 and is connected by way of a liquid trap 32 with a vacuum source 33. The upper end of tube 26 is properly aligned coaxially with the upper end of head 23 of the nozzle element 22. A top 36 perpendicular to the axis of the tube 26 is supported on two small oppositely disposed supports 35 the upper end of tube 26, the diameter of which nearly corresponds to the diameter of head 23. The bottom side of top 36, together with the top side of tube 26 and that of head 23, form an annular channel 37 through which the vacuum source 33 syphons air through the tube 26.

When the cap 4 has been advanced to the sealant application station by the cap holder the cap 4 with the cap holder 11 is lowered over top 36 and head 23 of nozzle element 22, so that the annular channel 37 and the openings of the apertures 25 are inserted into the set-off part 7 of projection 6 of cap 4, whereby the openings of the apertures 25 are located opposite and close to the lower edge of cap 4. When the cap 4 assumes this position, a small quantity of sealing material is extruded along channel 27 through apertures 25 against the inside of cap 4 substantially tangentially by brief activation of the metering pump 30. The thus extruded quantity is greater than that needed to moisten the ring surface of cap 4. Excess material, which does not adhere to cap 4, is carried away, together with the vacuumed air, through annular gap 37 into tube 26 by the vacuum source 33. As a result, an even quantity of sealing material adheres to the lower edge of the interior side of cap 4 in the area of off-set part 7 as a film which does not run and does not form droplets. The excess sealing material, which has been syphoned off together with air, is retained in the fluid trap 32 and can be returned to the sealing material supply. The thickness of the applied film of sealing material can be adjusted by changing the vacuum pressure prevailing at annular gap 37.

The cap 4, thus prepared to seal a capsule body 1, is moved to sealing station 40 of the sealing device by an upward, translational, and downward movement of cap holder 11 (FIG. 3). A filled capsule body 1 is simultaneously moved to sealing station 40 in a carrier 41 of a cyclically rotated feed wheel 42. When cap holder 11 is lowered, the accompanying cap 4 is set onto the upper part 7 of trunk 2 of capsule body 1. Subsequently, first sleeve 12 and later slide rod 13 of cap holder 11 is lifted so that the cap 4 remains on top of capsule body 1. The film of sealing material, previously applied to the inside of cap 4, now also moistens the adjacent upper part 7 of capsule body 1. By evaporation of the water content of the sealing material the etched surfaces of cap 4 and capsule body 1 become firmly and tightly bonded. After lifting cap holder 11 at sealing station 40, the cap holder returns again in sequence to receiving station 10, to start a new operational cycle in the manner described above.

It is further noted that several cap holders 11, sealing material application nozzles 22 and carriers 41 can always be consolidated into one unit so that, to increase production, one operational cycle can always treat several capsules as is the case in known capsule filling and sealing machines.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A sealing device for applying a proper amount of sealant onto a cap of a two-piece capsule comprising a capsule body (1) and an attachable cap (4), said sealing device comprises at least one capsule-body carrier (41) and at least one cap holder (11), each of which are movable relative to one another for assembly of the cap onto the capsule body, said device including a nozzle element (22 ) for insertion into said cap which is held by said cap holder, a tube (26) in said nozzle that forms a co-axial annular channel (27) through which viscose sealing material is applied to an inside surface of the cap, said nozzle element (22) includes apertures (25) which extend to said annular channel (27) at an angle relative to radial lines of said nozzle element (22), and a vacuum mechanism connected to said tube (26), said tube (26) includes top (36) which forms an annular channel between an end of said nozzle element (22) and said top through which said vacuum mechanism evacuates excessively applied sealing material from said cap through said tube.

2. A device in accordance with claim 1, in which said apertures in said nozzle means are tilted by 45° in relation to a radial line in a plane perpendicular to a linear axis of said nozzle element.

* * * * *